US009885170B2

(12) United States Patent
Katayanagi

(10) Patent No.: US 9,885,170 B2
(45) Date of Patent: Feb. 6, 2018

(54) CAB AND WORK VEHICLE

(71) Applicant: KOMATSU LTD., Tokyo (JP)

(72) Inventor: Hitoshi Katayanagi, Hirakata (JP)

(73) Assignee: KOMATSU LTD., Tokyo (JP)

( * ) Notice: Subject to any disclaimer, the term of this patent is extended or adjusted under 35 U.S.C. 154(b) by 0 days.

(21) Appl. No.: 15/036,449

(22) PCT Filed: Jun. 9, 2015

(86) PCT No.: PCT/JP2015/066552
§ 371 (c)(1),
(2) Date: May 13, 2016

(87) PCT Pub. No.: WO2016/199217
PCT Pub. Date: Dec. 15, 2016

(65) Prior Publication Data

US 2017/0167111 A1 Jun. 15, 2017

(51) Int. Cl.

| | |
|---|---|
| ***E02F 9/16*** | (2006.01) |
| ***H01H 3/02*** | (2006.01) |
| ***E02F 9/24*** | (2006.01) |
| ***E02F 9/20*** | (2006.01) |
| *E02F 3/76* | (2006.01) |

(52) U.S. Cl.
CPC ..... *E02F 9/16* (2013.01); *E02F 9/163* (2013.01); *E02F 9/2004* (2013.01); *E02F 9/24* (2013.01); *H01H 3/022* (2013.01); *E02F 3/7604* (2013.01)

(58) Field of Classification Search
CPC .... E02F 9/16; E02F 9/24; E02F 9/163; H01H 3/022; F02D 17/04; F02D 29/02
See application file for complete search history.

(56) References Cited

U.S. PATENT DOCUMENTS

| | | | | |
|---|---|---|---|---|
| 2,907,853 | A * | 10/1959 | Warren | H01H 3/022 200/546 |
| 6,955,239 | B2 * | 10/2005 | Ueda | A47C 1/121 180/326 |
| 7,162,839 | B2 * | 1/2007 | Ohno | B21D 22/04 428/597 |
| 7,434,863 | B2 * | 10/2008 | Hamazaki | B60N 2/146 296/65.06 |
| 8,434,562 | B2 * | 5/2013 | Miyasaka | E02F 5/32 172/431 |

(Continued)

FOREIGN PATENT DOCUMENTS

| | | |
|---|---|---|
| JP | H04-41561 U | 4/1992 |
| JP | H08-242611 A | 9/1996 |

(Continued)

*Primary Examiner* — Paul N Dickson
*Assistant Examiner* — Timothy Wilhelm
(74) *Attorney, Agent, or Firm* — Drinker Biddle & Reath LLP

(57) ABSTRACT

Provided is a cab in which an engine stop switch can be caused to make an emergency stop and an improper operation of the engine stop switch can be suppressed. The cab includes an operator's seat placed in the cab and the engine stop switch for causing the engine to make an emergency stop. The operator's seat includes a back portion serving as a backrest. The engine stop switch is provided rearward relative to a perpendicular line which is perpendicular to a midline bisecting the operator's seat as seen in a plan view and passes the back portion.

9 Claims, 5 Drawing Sheets

(56) References Cited

U.S. PATENT DOCUMENTS

| | | | | |
|---|---|---|---|---|
| 8,610,551 | B2 * | 12/2013 | Shimazu | E02F 9/2025 340/425.5 |
| 8,985,263 | B2 * | 3/2015 | Peterson | E21F 13/025 180/317 |
| 9,257,242 | B2 * | 2/2016 | Abe | B60R 25/2063 |
| 2006/0214515 | A1 * | 9/2006 | Pullmann | H03K 17/9502 307/326 |
| 2012/0224941 | A1 * | 9/2012 | Peterson | E21F 13/025 414/507 |
| 2013/0207797 | A1 | 8/2013 | Shimazu et al. | |

FOREIGN PATENT DOCUMENTS

| | | | |
|---|---|---|---|
| JP | H10-155350 | A | 6/1998 |
| JP | 2001-026947 | A | 1/2001 |
| JP | 2007-162313 | A | 6/2007 |
| JP | 2009-137538 | A | 6/2009 |
| JP | 2011-116253 | A | 6/2011 |
| WO | WO-2012/060355 | A1 | 5/2012 |

* cited by examiner

CAB AND WORK VEHICLE

TECHNICAL FIELD

The present invention relates to a cab and a work vehicle which includes the cab.

BACKGROUND ART

In a work vehicle, such as bulldozer and hydraulic excavator, an engine stop switch is provided as a device for stopping operation of the work vehicle promptly. An operator can stop an engine by operating the engine stop switch, without turning off a key switch for switching start and stop of the engine.

Conventionally, a work vehicle on which an engine stop switch is provided below an operator's seat is proposed (for example, refer to PTD 1).

CITATION LIST

Patent Document

PTD 1: WO2012/060355

SUMMARY OF INVENTION

Technical Problem

It is necessary to operate the engine stop switch in the emergency. Therefore, it is desirable to place the engine stop switch in a position where the operator sitting on the operator's seat can operate the engine stop switch promptly. Moreover, it is desirable to install the engine stop switch in an open state rather than to cover the engine stop switch with covering described in PTD 1. On the other hand, since the engine will stop if the engine stop switch is operated accidentally, it is necessary to place the engine stop switch so that an improper operation of the engine stop switch by an unexpected external force may be hard to occur.

An object of the present invention is to provide a cab in which an engine stop switch can be caused to make an emergency stop and an improper operation of the engine stop switch can be suppressed, and a work vehicle including the cab.

Solution to Problem

A cab of the present invention is a cab for a work vehicle and includes an operator's seat placed in the cab and an engine stop switch for causing an engine to make an emergency stop. The operator's seat includes a back portion serving as a backrest. The engine stop switch is provided rearward relative to a line which is perpendicular to a midline bisecting the operator's seat as seen in a plan view and passes the back portion.

The cab includes a side rack placed laterally with respect to the operator's seat in the cab. The side rack includes a first mount portion and a second mount portion mounted with the engine stop switch and adjacent to the first mount portion. An upper surface of the second mount portion is located lower in a upward/downward direction relative to an upper surface of the first mount portion.

The cab includes a handled portion handled by an operator sitting on the operator's seat and provided at the first mount portion.

Regarding the cab, three sides of a surrounding of the engine stop switch are exposed.

Regarding the cab, a top surface of the engine stop switch is located at or lower in the upward/downward direction than the upper surface of the first mount portion.

Regarding the cab, the engine stop switch is a push button switch and, when the engine stop switch is pushed, a top surface of the engine stop switch is located lower in the upward/downward direction than the upper surface of the first mount portion.

Regarding the cab, the engine stop switch is a push button switch and, when the engine stop switch is pushed, a top surface of the engine stop switch is located higher in the upward/downward direction than a topmost surface of the second mount portion.

Regarding the cab, the second mount portion is adjacent to and located rearward of the first mount portion.

Regarding the cab, the upper surface of the second mount portion is mounted only with the engine stop switch.

Regarding the cab, the midline tilts with respect to a front-rear direction of the cab, so that the closer the midline is to its frontmost end the further it tilts rightward and the closer the midline is to its rearmost end the further it tilts leftward. The side rack is placed left-rearward of the operator's seat.

A bulldozer of the present invention includes an engine and the above-described cab.

Advantageous Effects of Invention

According to the present invention, the engine stop switch can be caused to make an emergency stop, and an improper operation of the engine stop switch can be suppressed.

DESCRIPTION OF EMBODIMENTS

Figure 1:
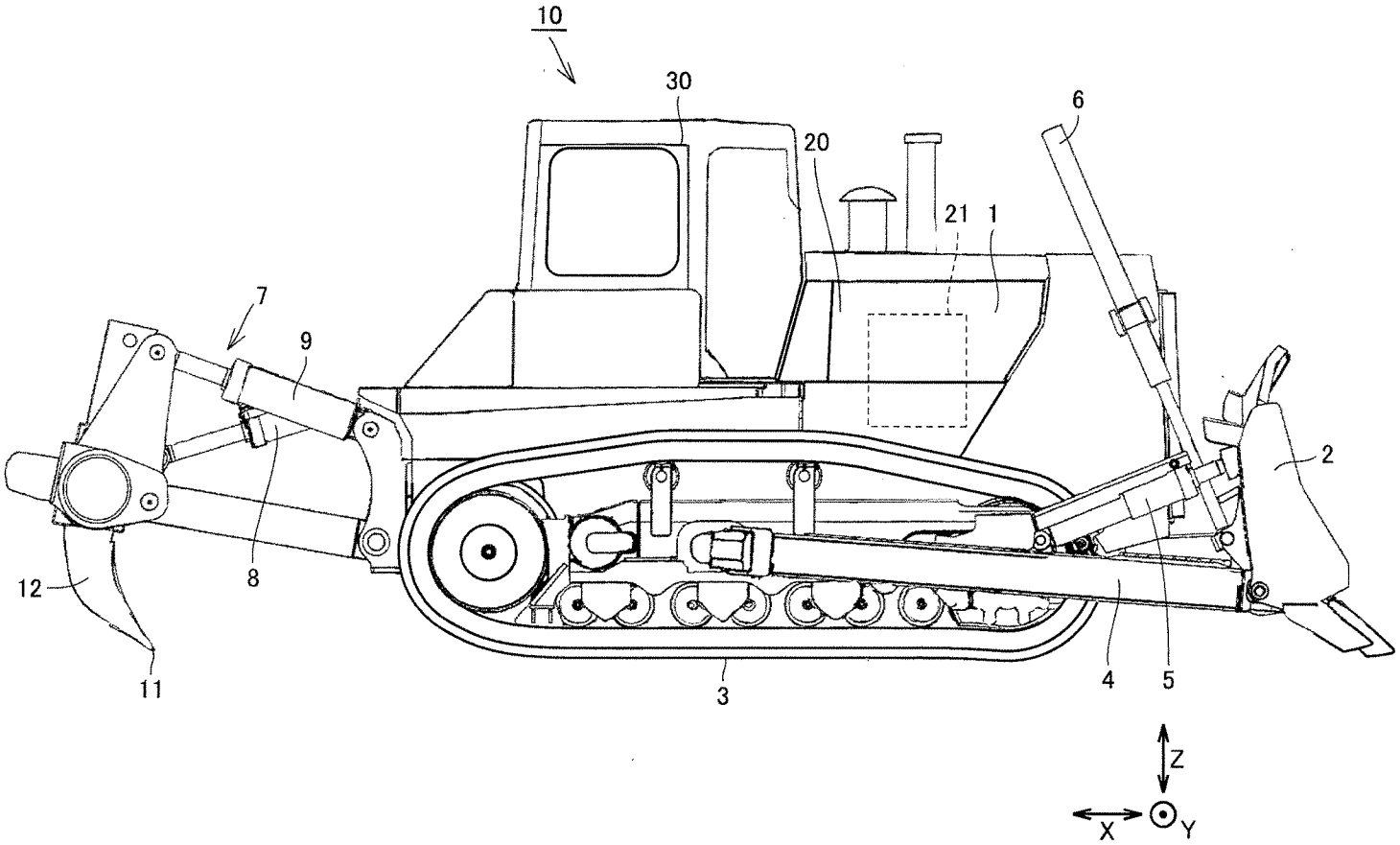
FIG. 1 is a side view schematically showing the configuration of a bulldozer in the embodiment of the present invention.

Hereinafter, embodiments of the present invention will be described based on the drawings.

First, the configuration of a bulldozer which is an example of a work vehicle to which the idea of the present invention is applicable will be described.

In the present embodiment, the forward side (front side) of an operator sitting in a cab 30 is defined as the forward side of a bulldozer 10, the rear side of the operator sitting therein is defined as the rear side of bulldozer 10, the left side of the operator in the seated state is defined as the left side of bulldozer 10, and the right side of the operator in the seated state is defined as the right side of bulldozer 10. The front-rear direction means the front-rear direction seen from the operator sitting on an operator's seat of cab 30. The left/right direction, the vehicle width direction or the lateral direction is the direction of the right and left seen from the above-described operator. In the drawings below, the front-rear direction is shown with an arrow X in the drawings, the left/right direction is shown with an arrow Y in the drawings, and the upward/downward direction is shown with an arrow Z in the drawings.

FIG. 1 is a side view schematically showing the configuration of a bulldozer 10 in the embodiment of the present invention. As shown in FIG. 1, bulldozer 10 of the present embodiment mainly includes a traveling apparatus, a vehicular body 1, a blade 2, and a ripper apparatus 7. The traveling apparatus has a pair of left and right crawler travel units 3 at a distance in the vehicle width direction (the direction of Y). Vehicular body 1 is placed between the pair of left and right crawler travel units 3. Blade 2 is placed at the front position of vehicular body 1. Ripper apparatus 7 is placed at the rear position of vehicular body 1.

Vehicular body 1 has a cab (operator's cab) 30 and an engine compartment 20. Cab 30 is placed in the rear upper part of vehicular body 1. Engine compartment 20 is placed frontward of cab 30. Engine compartment 20 is placed between cab 30 and blade 2. An engine 21 is accommodated in engine compartment 20. Cab 30 is configured so that it may have the operator's seat inside for the operator to be seated and may surround the operator's seat.

Bulldozer 10 includes blade 2 as a work implement in the front thereof. Blade 2 is the work implement for working the digging of earth and sand, land grading, and the like. Blade 2 has its right and left sides both supported by a frame 4. Blade 2 is driven by tilt cylinders 5 and lift cylinders 6.

Bulldozer 10 includes ripper apparatus 7 as a work implement in the rear thereof. Ripper apparatus 7 is the work implement for penetrating and crushing the hard material, such as rock. Ripper apparatus 7 has a shank 12. A ripper tip 11 is provided at the lower end of shank 12. Ripper apparatus 7 thrusts ripper tip 11 into rock and the like and performs cutting or crushing with the traction by the traveling apparatus. Ripper apparatus 7 is driven by lift cylinders 8 and tilt cylinders 9.

Figure 2:
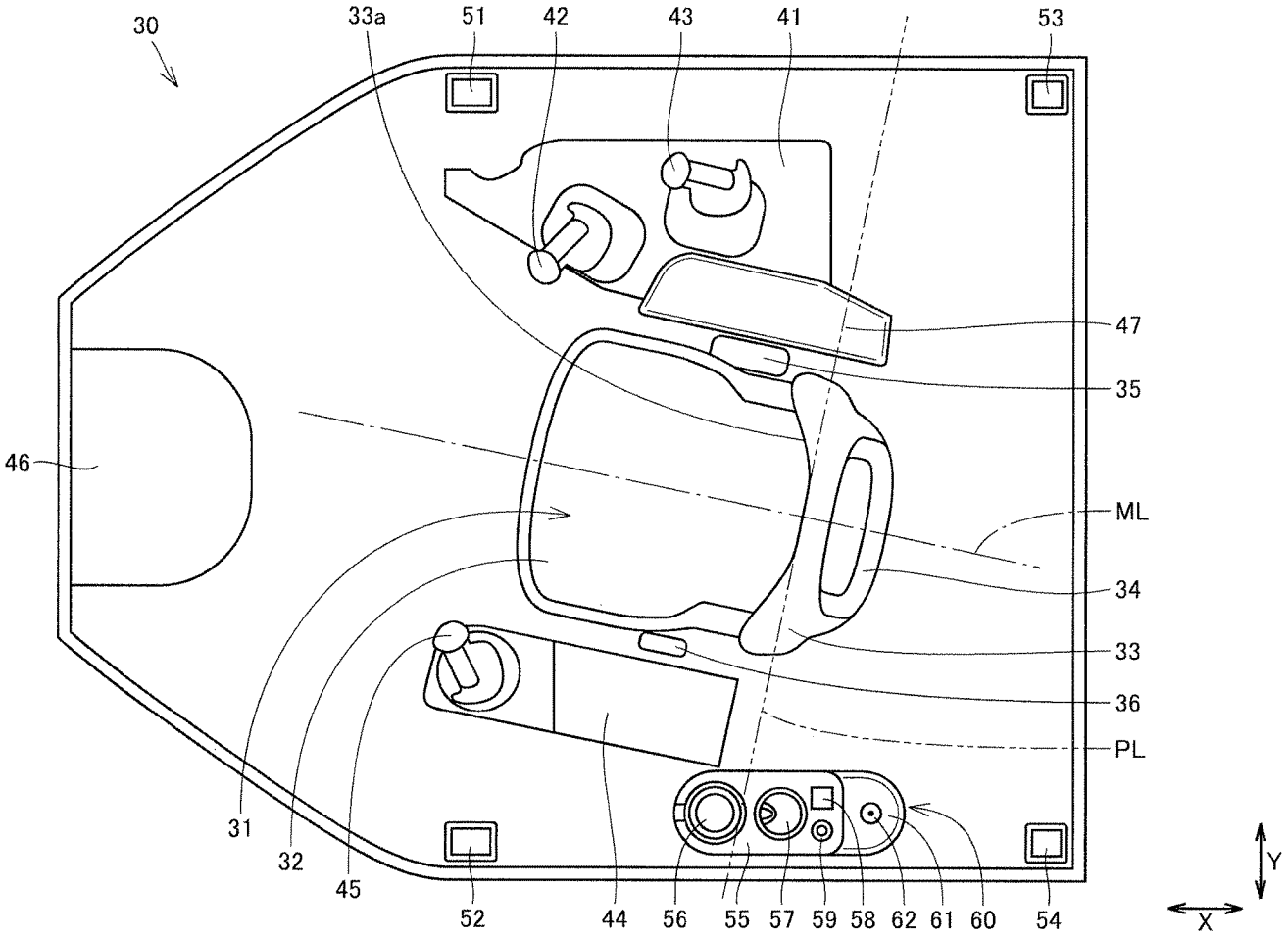
FIG. 2 is a plan view schematically showing the configuration inside a cab shown in FIG. 1.

FIG. 2 is a plan view schematically showing the configuration inside cab 30 shown in FIG. 1. As shown in FIG. 2, an operator's seat 31 is placed inside cab 30. Cab 30 has a roof portion which is arranged to cover operator's seat 31, and a plurality of pillars which support the roof portion. Each pillar extends along the upward/downward direction (the direction of Z), and is connected with the floor portion and the roof portion of cab 30.

The plurality of pillars have front pillars 51 and 52 and rear pillars 53 and 54. Front pillars 51 and 52 are placed frontward with respect to operator's seat 31 in the front-rear direction (the direction of X). Rear pillars 53 and 54 are placed rearward with respect to operator's seat 31 in the front-rear direction (the direction of X). Front pillar 51 and rear pillar 53 are placed rightward with respect to operator's seat 31 in the vehicle width direction (the direction of Y). Front pillar 52 and rear pillar 54 are placed leftward with respect to operator's seat 31 in the vehicle width direction (the direction of Y).

Operator's seat 31 is placed near a substantially center of cab 30. Operator's seat 31 has a seating portion 32, a back portion 33, and a headrest 34. The operator who gets into cab 30 is seated on seating portion 32. In order that the operator who is seated on seating portion 32 may lean the back, back portion 33 is provided. Back portion 33 serves as a backrest. Side supports protruding frontward are provided on a left end and a right end of back portion 33 in order to support the seated operator so that the operator may not be moved. Headrest 34 is attached to the upper end of back portion 33. Headrest 34 protects the operator's head from an impact.

A front console 46 is placed frontward of operator's seat 31 in cab 30. A control panel, meters and switches are attached to front console 46.

A right console 41 is placed rightward of operator's seat 31 in cab 30. Levers for operation of the work implement are provided on right console 41. A blade control lever 42 for operating blade 2 and a ripper control lever 43 for operating ripper apparatus 7 are attached to right console 41. Blade control lever 42 is placed at the front side of right console 41. Ripper control lever 43 is placed right-rearward of blade control lever 42.

A right armrest 47 is placed rightward of operator's seat 31 in cab 30. Right armrest 47 is placed laterally with respect to operator's seat 31. In the vehicle width direction (the direction of Y), right armrest 47 is placed between operator's seat 31 and right console 41. Right armrest 47 is placed between ripper control lever 43 and operator's seat 31.

A left console 44 is placed leftward of operator's seat 31 in cab 30. On left console 44, a lever for travel operation of bulldozer 10 is provided. A travel control lever 45 is attached to left console 44. Travel control lever 45 is placed at the front side of left console 44. The rear side of left console 44 is provided as a left armrest.

A belt accommodation portion 35 which accommodates a seat belt is placed rightward of operator's seat 31 in cab 30. Belt accommodation portion 35 is placed between operator's seat 31 and right armrest 47. A locking portion 36 which locks the seat belt is placed leftward of operator's seat 31 in cab 30. Locking portion 36 is placed between operator's seat 31 and left console 44. The seat belt is pulled out from belt accommodation portion 35, and a locking metal fitting at a tip of the seat belt is locked to locking portion 36, thereby the seat belt is worn around the body of the operator sitting on operator's seat 31.

A side rack 60 is placed leftward of operator's seat 31 in cab 30. Side rack 60 is placed laterally with respect to operator's seat 31. Side rack 60 is placed left-rearward of operator's seat 31.

Side rack 60 includes a first mount portion 55 and a second mount portion 61. A cup holder 56, an ashtray 57, a cigarette lighter 58, and an external connection terminal 59 are provided at first mount portion 55. Cup holder 56, ashtray 57, cigarette lighter 58, and external connection terminal 59 are collectively placed on first mount portion 55. Cup holder 56, ashtray 57, cigarette lighter 58, and external connection terminal 59 configure the handled portion handled by the operator sitting on operator's seat 31.

Second mount portion 61 is placed adjacent to first mount portion 55. Second mount portion 61 is adjacent to and located rearward of first mount portion 55. Second mount portion 61 is mounted with an engine stop switch 62. Engine stop switch 62 is a switch for causing engine 21 (FIG. 1) to make an emergency stop. An upper surface of second mount portion 61 is mounted only with engine stop switch 62. No devices other than engine stop switch 62 is mounted on the upper surface of second mount portion 61.

An alternate long and short dash line in FIG. 2 shows a midline ML of operator's seat 31. Here, the midline is a virtual line by which operator's seat 31 is equally divided into right part and left part. In a front view of operator's seat 31, midline ML passes along the center of the right and left of operator's seat 31. In a rear view of operator's seat 31, midline ML passes along the center of the right and left of operator's seat 31. As seen in the plan view shown in FIG. 2, midline ML passes the center of operator's seat 31, and extends in the position which bisects operator's seat 31.

If operator's seat 31 has a symmetrical shape, midline ML is on the plane of symmetry. However, operator's seat 31 of the present embodiment may not be completely symmetrical. Midline ML may be a line which bisects a member with a symmetrical shape which configures a portion of operator's seat 31. Midline ML may be a line which bisects a part with a symmetrical shape of a member which configures a portion of operator's seat 31. For example, midline ML may be the line which bisects seating portion 32, may be the line which bisects back portion 33, or may be the line which bisects headrest 34.

As shown in FIG. 2, midline ML of operator's seat 31 tilts with respect to the front-rear direction (the direction of X) of cab 30, so that the closer the midline is to its frontmost end the further it tilts rightward and the closer the midline is to its rearmost end the further it tilts leftward. Operator's seat 31 is fixed at a position that the seated operator faces a direction tilted rightward with respect to front direction in the front-rear direction of the bulldozer as seen in the plan view.

The chain double-dashed line in FIG. 2 shows a perpendicular line PL perpendicular to midline ML as seen in the plan view and passing back portion 33 of operator's seat 31.

Figure 3:
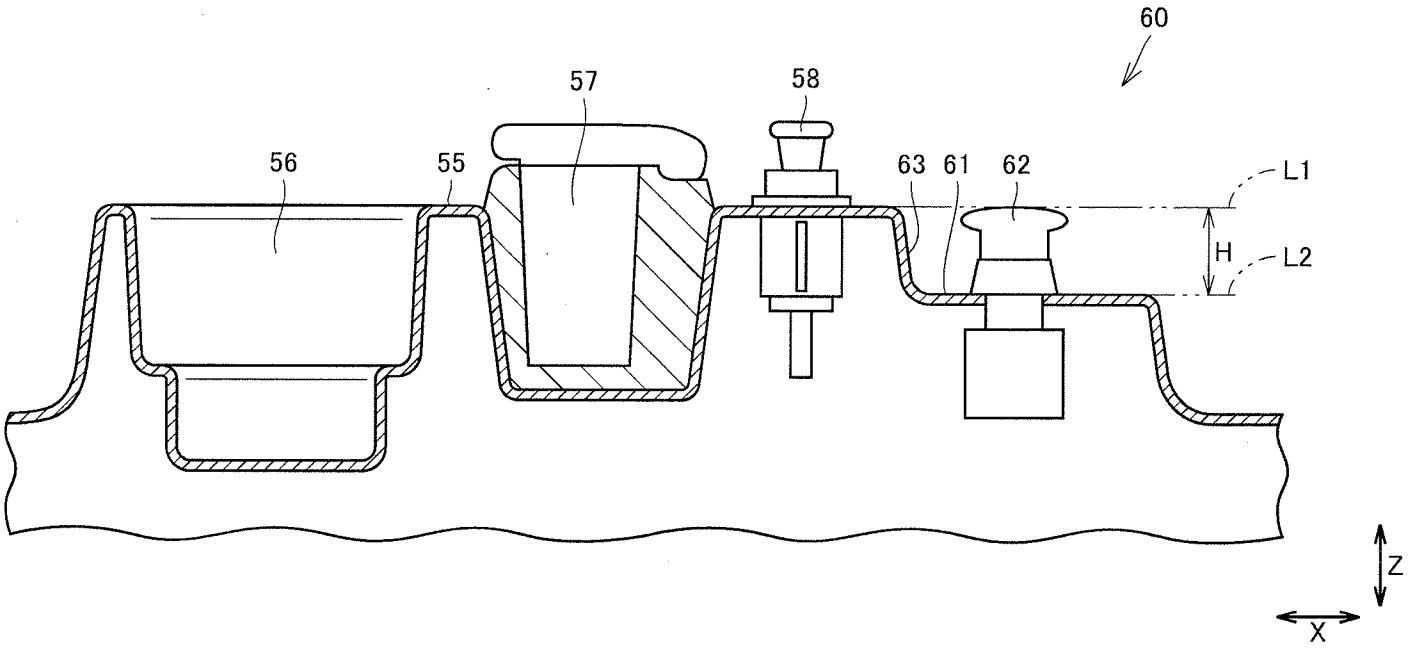
FIG. 3 is an enlarged cross sectional view showing the details of the configuration of a side rack.

FIG. 3 is an enlarged cross sectional view showing the details of the configuration of side rack 60. In FIG. 3, cup holder 56, ashtray 57, and cigarette lighter 58 provided on first mount portion 55 are illustrated. In FIG. 3, in addition, engine stop switch 62 provided on second mount portion 61 is illustrated. Second mount portion 61 is provided substantially rearward relative to perpendicular line PL as seen in the plan view. Engine stop switch 62 is provided rearward relative to perpendicular line PL as seen in the plan view. In FIG. 2, perpendicular line PL passes the rearmost portion of a front surface 33*a* of the back portion. Perpendicular line PL is not restricted to the position shown with FIG. 2, and may pass an arbitrary portion of back portion 33, for example, the rearmost portion of back portion 33.

A line L1 shown with the chain double-dashed line in FIG. 3 shows the position of an upper surface of first mount portion 55. A line L2 shown with the chain double-dashed line in FIG. 3 shows the position of the upper surface of second mount portion 61. As shown in FIG. 3, the upper surface of second mount portion 61 is located lower in the upward/downward direction relative to the upper surface of first mount portion 55. Between the upper surface of first mount portion 55 and the upper surface of second mount portion 61, a level difference of height H shown in FIG. 3 is formed.

Engine stop switch 62 is a push button switch. Switching operation of the switch is performed by pushing engine stop switch 62 with a hand. The position of a top surface of engine stop switch 62 in the upward/downward direction is the same as the upper surface of first mount portion 55. The position of a top surface of engine stop switch 62 in the upward/downward direction may be lower than the upper surface of first mount portion 55. The top surface of engine stop switch 62 is located at or lower in the upward/downward direction than the upper surface of first mount portion 55.

A wall portion 63 which connects the upper surface of first mount portion 55 and the upper surface of second mount portion 61 is provided at the rear end of first mount portion 55 and at the front end of second mount portion 61. Engine stop switch 62 faces wall portion 63.

Figure 4:
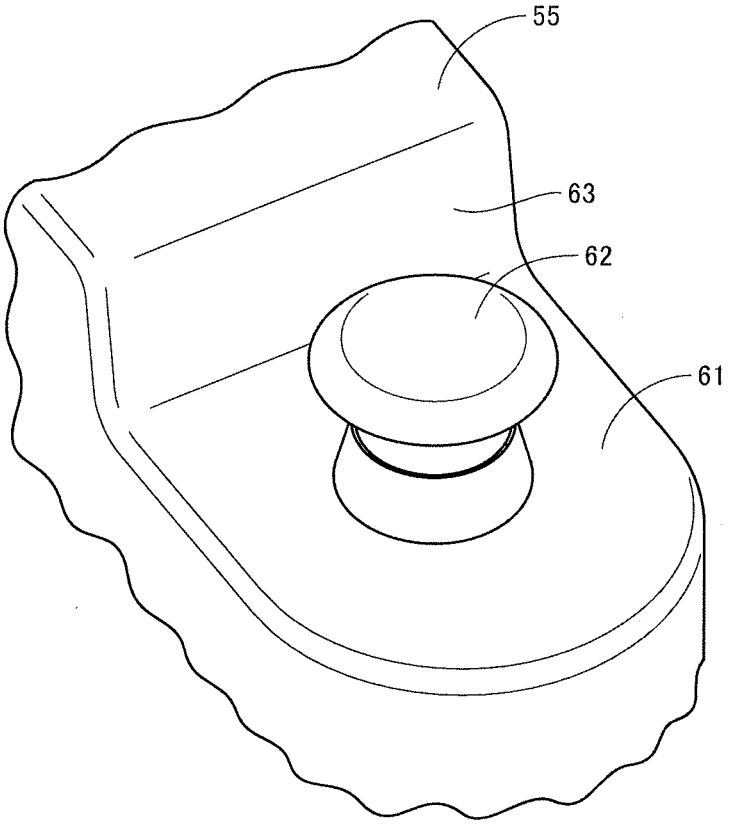
FIG. 4 is a perspective view of an engine stop switch.

FIG. 4 is a perspective view of engine stop switch 62. As shown in FIG. 4, the upper surface of second mount portion 61 is mounted only with engine stop switch 62. No member or device is provided around engine stop switch 62 other than wall portion 63 which connects first mount portion 55 and second mount portion 61.

Second mount portion 61 in the present embodiment has a flat surface, however, second mount portion may have a curve or protrusion so long as it does not hinder the operation of engine stop switch 62.

Wall portion 63 is provided on one side of a surrounding of engine stop switch 62, and the other three sides of the surrounding of engine stop switch 62 are exposed. Wall portion 63 is provided frontward of engine stop switch 62. No wall portion is provided rightward, leftward and rearward of engine stop switch 62. Engine stop switch 62 is placed so that three sides of right side, left side and rear side of engine stop switch are exposed. In the three sides of right side, left side and rear side relative to engine stop switch 62, any structure or device which may hinder the operation of engine stop switch 62 is not provided.

Figure 5:
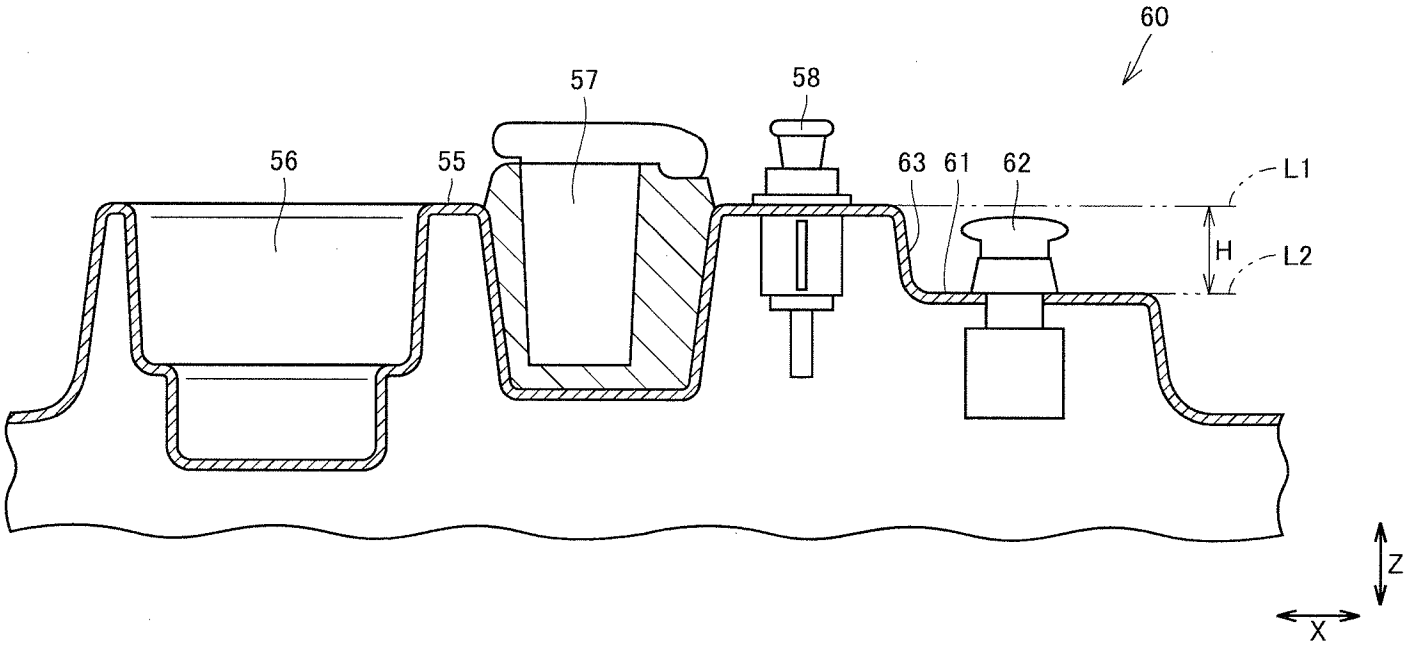
FIG. 5 is a cross sectional view of the side rack showing the state where the engine stop switch is operated.

FIG. 5 is a cross sectional view of the side rack 60 showing the state where the engine stop switch 62 is operated. Engine stop switch 62 is the push button switch, and the state where engine stop switch 62 is pushed and move downward is illustrated in FIG. 5.

As shown in FIG. 5, when engine stop switch 62 is pushed, the top surface of engine stop switch 62 is located lower in the upward/downward direction than the upper surface of first mount portion 55. The top surface of engine stop switch 62 is placed in the position lower than line L1 which shows the position of the upper surface of first mount portion 55. When engine stop switch 62 is pushed, the top surface of engine stop switch 62 is placed in the region between line L1 which shows the position of the upper surface of first mount portion 55 and line L2 which shows the position of the upper surface of second mount portion 61.

When engine stop switch 62 is pushed, the top surface of engine stop switch 62 is located higher in the upward/downward direction than the upper surface of second mount portion 61. If second mount portion 61 has unevenness, the top surface of engine stop switch 62 is located higher in the upward/downward direction than the topmost surface of second mount portion 61.

Next, the function and effect of the present embodiment is explained.

Cab 30 of the present embodiment includes operator's seat 31 and side rack 60, as shown in FIG. 2. Side rack 60 is placed leftward in the vehicle width direction (the direction of Y) with respect to operator's seat 31.

Side rack 60 has first mount portion 55. Cup holder 56, ashtray 57, cigarette lighter 58, and external connection terminal 59 are provided at first mount portion 55. Cup holder 56, ashtray 57, cigarette lighter 58, and external connection terminal 59 configure the handled portion handled by the operator sitting on operator's seat 31.

Side rack 60 has second mount portion 61. Second mount portion 61 is mounted with engine stop switch 62 for causing engine 21 to make an emergency stop. Second mount portion 61 is adjacent to first mount portion 55.

As shown in FIG. 3, the upper surface of second mount portion 61 is located lower in the upward/downward direction relative to the upper surface of first mount portion 55. As shown in FIG. 4, three sides of the surrounding of engine stop switch 62 are exposed.

Since engine stop switch 62 is placed on side rack 60, the operator sitting on operator's seat 31 can reach out to second mount portion 61 and can operate engine stop switch 62. Frontward of engine stop switch 62 wall portion 63 is provided, but the other three sides of the surrounding of engine stop switch 62 are exposed without being provided with a wall. There is no covering which covers engine stop switch 62, and engine stop switch 62 is exposed. When the operator tries to operate engine stop switch 62 in the emergency, the operator's operation is not hindered by the structure around engine stop switch 62. Therefore, the operator can operate engine stop switch 62 promptly and cause engine 21 to make an emergency stop.

Second mount portion 61 is provided with engine stop switch 62. Second mount portion 61 is placed in the position different from first mount portion 55 at which the handled portion handled by the operator is provided. Thereby, an accidental contact with engine stop switch 62 by the operator when the operator handles the handled portion can be restrained. Since the upper surface of second mount portion 61 is located lower than the upper surface of first mount portion 55, an unintentional contact with engine stop switch 62 can be more reliably avoided. Therefore, an improper operation of engine stop switch 62 can be suppressed.

As shown in FIG. 3, the top surface of engine stop switch 62 is located at or lower in the upward/downward direction than the upper surface of first mount portion 55. Thereby, an accidental contact with engine stop switch 62 by the operator when the operator handles the handled portion can be restrained, and an improper operation of engine stop switch 62 can be suppressed.

As shown in FIG. 5, engine stop switch 62 is a push button switch, and the top surface of engine stop switch 62 when engine stop switch 62 is pushed is located lower in the upward/downward direction than the upper surface of first mount portion 55. Thereby, an accidental contact with engine stop switch 62 by the operator when the operator handles the handled portion can be restrained, and an improper operation of engine stop switch 62 can be suppressed.

As shown in FIG. 2, second mount portion 61 is adjacent to and located rearward of first mount portion 55. In side rack 60, by providing first mount portion 55 frontward and providing second mount portion 61 rearward, an unintentional contact with engine stop switch 62 by the operator when the operator handles the handled portion can be restrained. Therefore, an improper operation of engine stop switch 62 can be suppressed.

As shown in FIGS. 2 and 4, the upper surface of second mount portion 61 is mounted only with engine stop switch 62. Thereby, an unintentional contact with engine stop switch 62 can be restrained when the operator operates other devices or handles other member. Therefore, an improper operation of engine stop switch 62 can be suppressed.

As shown in FIG. 2, midline ML bisecting operator's seat 31 as seen in the plan view tilts with respect to the front-rear direction of cab 30, so that the closer the midline is to its frontmost end the further it tilts rightward and the closer the midline is to its rearmost end the further it tilts leftward. Side rack 60 is placed left-rearward of operator's seat 31. By placing side rack 60 in the position farther away from the operator sitting on operator's seat 31, an accidental contact with engine stop switch 62 by the operator can be restrained, and an improper operation of engine stop switch 62 can be suppressed. On the other hand, side rack 60 is placed in the position which the operator can reach by rotating the body. Therefore, in the emergency, the operator can rotate the body and operate engine stop switch 62.

The work vehicle of the present embodiment includes engine 21 and one of the above-mentioned cab 30. The operator sitting in cab 30 can operate engine stop switch 62 to cause engine 21 to make an emergency stop. In addition, an improper operation of engine stop switch 62 can be suppressed.

In cab 30 described above, as shown in FIG. 4, the periphery of second mount portion 61 on which engine stop switch 62 is provided extends, except for wall portion 63, downward with respect to the upper surface of second mount portion 61. The cab is not restricted to this configuration. A structure which protrudes slightly upward from the upper surface of second mount portion 61 may be provided in the three sides of a surrounding of second mount portion 61 except wall portion 63. However, in order not to hinder the emergent operation of engine stop switch 62, it is necessary to expose three sides of the surrounding of engine stop switch 62. Therefore, the height at which the structure protrudes from the upper surface of second mount portion 61 is defined so that it may become smaller than the distance from the upper surface of second mount portion 61 to the movable portion of engine stop switch 62.

Engine stop switch 62 is not restricted to the push button switch described above, but may be an arbitrary kind of switch such as a toggle switch. However, a push button switch which is switched between ON and OFF by pushing the button is suitable as engine stop switch 62 due to the characteristic of engine stop switch 62 that the emergent operation is required.

It should be construed that the embodiments disclosed herein are given by way of illustration in all respects, not by way of limitation. It is intended that the scope of the present invention is defined by claims, not by the description above, and encompasses all modifications and variations equivalent in meaning and scope to the claims.

REFERENCE SIGNS LIST

1 vehicular body; 2 blade; 7 ripper apparatus; 10 bulldozer; 21 engine; 30 cab; 31 operator's seat; 33 back portion; 33*a* front surface of the back portion; 41 right console; 42 blade control lever; 43 ripper control lever; 44 left console; 45 travel control lever; 46 front console; 47 right armrest; 55 first mount portion; 56 cup holder; 57 ashtray; 58 cigarette lighter; 59 external connection terminal; 60 side rack; 61 second mount portion and; 62 engine stop switch; 63 wall portion; ML midline; PL perpendicular line.

The invention claimed is:

1. A cab for a work vehicle, comprising:

an operator's seat placed in said cab and including a back portion serving as a backrest;

an engine stop switch for causing an engine to make an emergency stop, said engine stop switch being provided rearward relative to a line which is perpendicular to a midline bisecting said operator's seat as seen in a plan view and passes through said back portion, said midline tilting with respect to a front-rear direction of said cab, so that the closer the midline is to its frontmost end the further it tilts rightward and the closer the midline is to its rearmost end the further it tilts leftward, and said engine stop switch being placed left-rearward of said operator's seat, and a side rack placed laterally with respect to said operator's seat in said cab, wherein said side rack includes a first mount portion and a second mount portion mounted with said engine stop switch and adjacent to said first mount portion, and an upper surface of said second mount portion is located lower in a upward/downward direction relative to an upper surface of said first mount portion.

2. The cab according to claim 1, comprising a handled portion handled by an operator sitting on said operator's seat and provided at said first mount portion.

3. The cab according to claim 1, wherein three sides of a surrounding of said engine stop switch are exposed.

4. The cab according to claim 1, wherein a top surface of said engine stop switch is located at or lower in the upward/downward direction than the upper surface of said first mount portion.

5. The cab according to claim 1, wherein said engine stop switch is a push button switch, and when said engine stop switch is pushed, a top surface of said engine stop switch is located lower in the upward/downward direction than the upper surface of said first mount portion.

6. The cab according to claim 1, wherein said engine stop switch is a push button switch, and when said engine stop switch is pushed, a top surface of said engine stop switch is located higher in the upward/downward direction than a topmost surface of said second mount portion.

7. The cab according to claim 1, wherein said second mount portion is adjacent to and located rearward of said first mount portion.

8. The cab according to claim 1, wherein the upper surface of said second mount portion is mounted only with said engine stop switch.

9. A work vehicle comprising:

an engine; and the cab as recited in claim 1.

* * * * *